US005479780A

United States Patent [19]

McCabe

[11] Patent Number: 5,479,780

[45] Date of Patent: Jan. 2, 1996

[54] CIRCULAR INTERNAL COMBUSTION ENGINE

[76] Inventor: Thomas J. McCabe, 4312 Le Bourget Ave., Culver City, Calif. 90232

[21] Appl. No.: 297,614

[22] Filed: Aug. 29, 1994

[51] Int. Cl.[6] ..... F02B 75/22; F02G 3/02

[52] U.S. Cl. ..... 60/624; 123/54.3

[58] Field of Search ..... 60/624; 123/54.3, 123/47 A, 188.66; 417/273

[56] References Cited

U.S. PATENT DOCUMENTS

| | | | |
|---|---|---|---|
| 836,945 | 11/1906 | Poole | 60/624 |
| 2,466,215 | 4/1949 | Ekleberry | 417/273 |
| 2,665,668 | 1/1954 | Ward | 60/624 |

FOREIGN PATENT DOCUMENTS

| | | | |
|---|---|---|---|
| 908895 | 10/1945 | France | 60/624 |
| 172484 | 6/1906 | Germany | 123/54.3 |
| 111084 | 6/1918 | United Kingdom | 123/188.16 |

*Primary Examiner*—Michael Koczo

[57] ABSTRACT

A circular internal combustion engine includes a torque shaft, a central cam connected to the torque shaft, a stationary middle ring located about the central cam, and, an exhaust ring assembly located about the middle ring and connected to the torque shaft and the central cam. The middle ring provides stationary support for power chambers located between the central cam and the exhaust ring. Power shuttle assemblies utilize thermal energy from the power chambers to apply leverage on surfaces of the central cam and exhaust ring to provide rotational force.

10 Claims, 7 Drawing Sheets

CIRCULAR INTERNAL COMBUSTION ENGINE

BACKGROUND OF THE INVENTION

1. Field of the Invention

The present invention relates to internal combustion engines and more particularly to an internal combustion engine which is circular and provides means for transferring thermal energy from power chambers to both an outer exhaust ring and a central cam to provide a thermally efficient source of power.

2. Description of the Related Art

Engineers and scientists have spent many years attempting to enhance the thermal efficiency and torque of internal combustion engines. A significant limiting factor has been the fact that no particularly efficient way has been developed to utilize the combustion exhaust gases. For example, with most four-cycle engines an excessive amount of energy must be exhausted immediately after ignition and each cylinder must cycle vacantly to gain enough compression for the next power stroke.

Additionally, a significant amount of energy is required to operate internal components, such as the valve train, oil pump and coolant systems. A vast amount of time and money has been invested in the development of two-cycle engines with less than satisfactory results.

OBJECTS AND SUMMARY OF THE INVENTION

The present invention is a circular internal combustion engine. It includes a torque shaft, a central cam connected to the torque shaft, a stationary middle ring located about the central cam, and, an exhaust ring assembly located about the middle ring and connected to the torque shaft and the central cam. The middle ring provides stationary support for power chambers located between the central cam and the exhaust ring. Power shuttle assemblies utilize thermal energy from the power chambers to apply leverage on surfaces of the central cam and exhaust ring to provide rotational force.

The current invention takes advantage of the strengths of both reciprocating engines and turbine engines. Concurrently, it minimizes their weaknesses. The method in which gases are taken in and exhausted allows the engine to "breathe" very efficiently and still be able to apply the power of fuels used. Preferably, the intake valve is of the same diameter as the power chamber and the exhaust valve is also the same diameter of the power chamber. The present invention is easier to construct in large quantity than a reciprocating engine, because most of the components are redundant in form and there is no need for chains, sprocket, gears, belts, pulleys, etc.

The heat generated by this design is at the outer edge. Because the heat is dispersed quickly, lubricants are only needed in the central area. Unlike a turbine engine which must direct its exhaust gases for regenerative use, the present engine can disperse gases to a cooler environment immediately after use.

Other objects, advantages, and novel features will become apparent from the following detailed description of the invention when considered in conjunction with the accompanying drawings.

BRIEF DESCRIPTION OF THE DRAWINGS

The same parts or elements throughout the drawings are designated by the same reference characters.

DETAILED DESCRIPTION OF THE PREFERRED EMBODIMENTS

Figure 1:
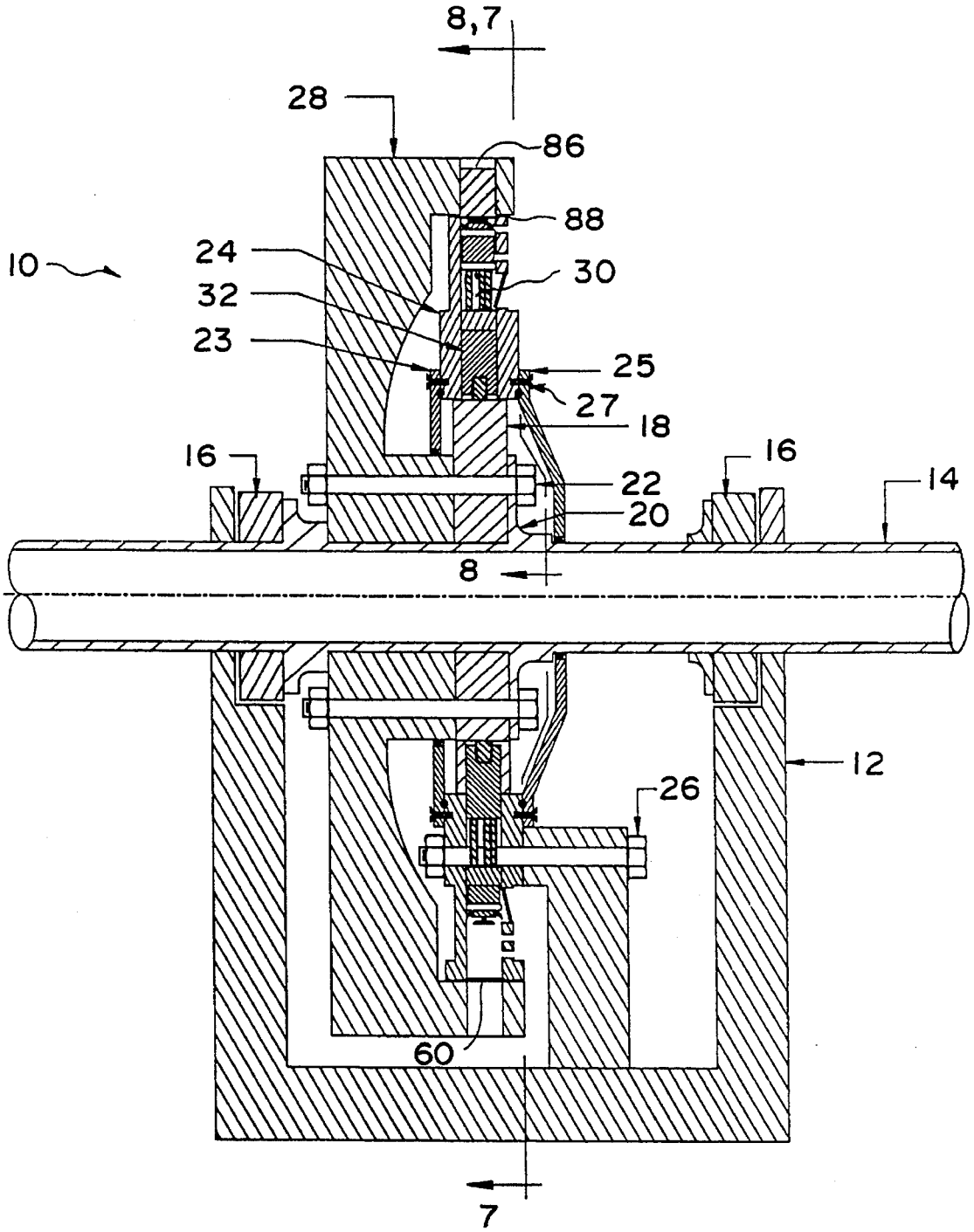
FIG. 1 is a cut-away side view of a preferred embodiment of the present invention in a fixed frame.

Referring now to the drawings and characters of reference marked thereon, FIG. 1 illustrates a preferred embodiment of the present invention, designated generally as 10. The engine 10 is shown supported on a support framework designated generally as 12. Such a support framework may include any number of applications, for example, an automobile chassis, a stationary power plant frame, a handheld lawn trimmer, a chain saw or even the hull of a ship.

Engine 10 comprises a torque shaft 14 which rotates relative to framework 12 by bearings 16. A central cam 18 is connected to a flange 20 of the shaft 14 by bolt and nut assembly 22.

A stationary middle ring 24 is located about the central cam 18. Middle ring 24 is fastened to the framework 12 by fastener or bolt 26. Seal plate assembly 23 and seal plate assembly 25 are attached to middle ring 24 by fasteners 27.

An exhaust ring assembly 28 is located about the outer surfaces of the middle ring 24. The middle ring 24 provides stationary support for a plurality of power chambers 30 which each support a respective power shuttle assembly 32.

Figure 3:
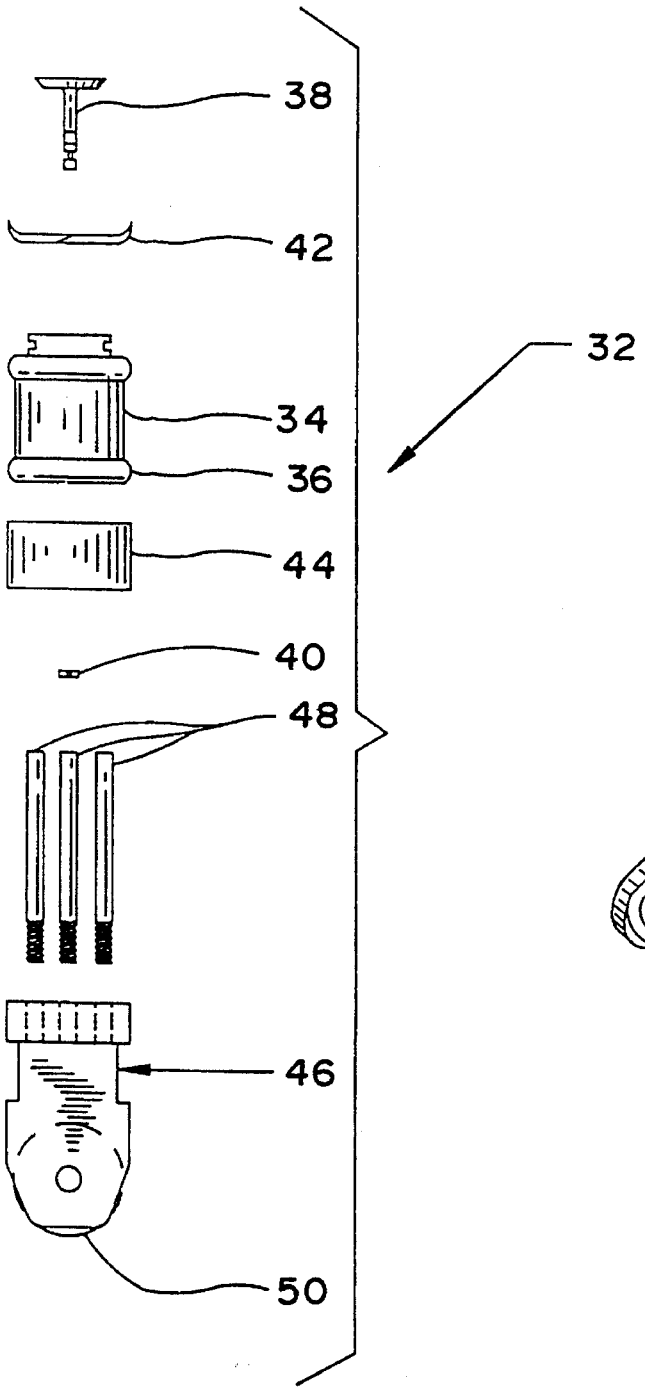
FIG. 3 is an exploded view of the power shuttle assembly of FIG. 2.
Figure 2:
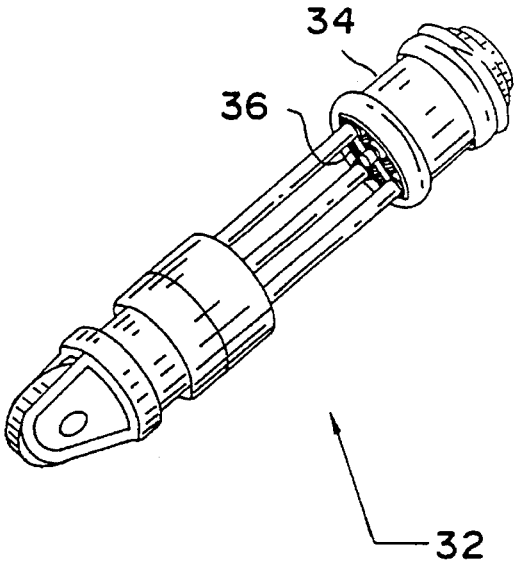
FIG. 2 is a perspective view of a power shuttle assembly.

Referring now to FIG. 2, a perspective view of a preferred power shuttle assembly 32 is shown. Each power shuttle assembly 32 comprises a shuttle body 34 which includes passages 36 for allowing the transfer of fluid therewithin. As can be readily seen in the exploded view of FIG. 3, shuttle valve 38 is contained within the shuttle body 34 to control fluid passage. A lock clip 40 secures the shuttle valve 38 within the shuttle body 34. The shuttle body 34 includes a compression seal 42 at an outward end. A chamber divider 44 fits between the shuttle body 34 and a cam driver assembly 46. A plurality of spaced connector pins 48 are positioned between the shuttle body and the cam driver assembly 46 which passes through chamber divider 44, for transmitting forces from the shuttle body 34 to the cam driver assembly 46 and for spacing the shuttle body 34 from the cam driver assembly 46 to accommodate fluid intake into the respective power chamber. Each cam driver assembly 46 preferably includes a roller bearing 50 which can contact the cam 18 outer surface.

Figure 4:
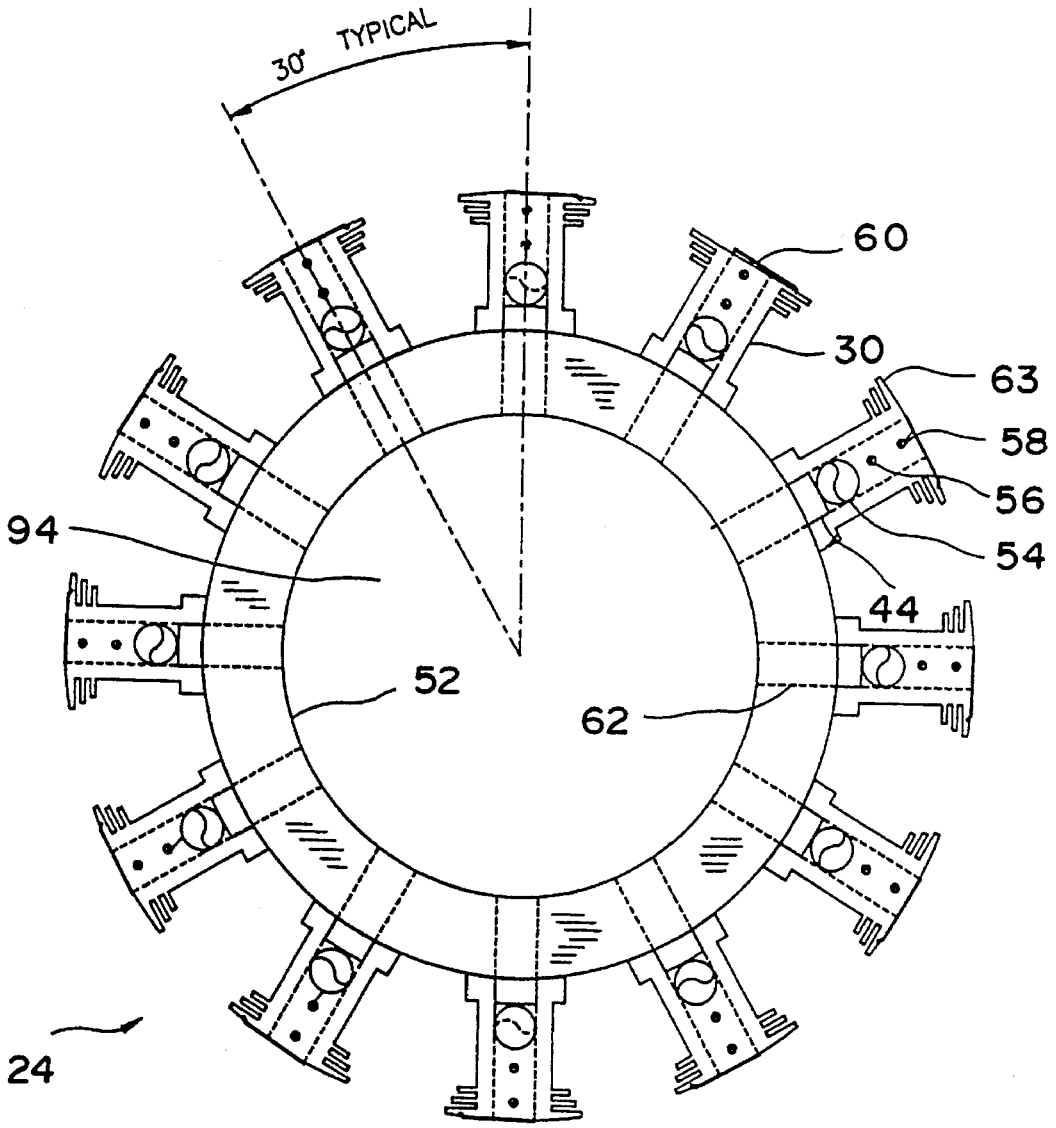
FIG. 4 is a front view of the middle ring showing the fuel ports, the ignition ports and the hinged exhaust valves.

Referring now to FIG. 4, a front view of a middle ring 24 is shown. Middle ring 24 includes a chamber support ring 52 which supports the power chambers 30. The power chambers 30 are preferably formed as an integral part of the support ring 52. Each chamber divider 44 is also preferably cast as an integral part of support ring 52.

An intake check valve port 54, the chamber divider 44, a fuel port 56, an ignition port 58, and an exhaust valve 60 are provided on each power chamber 30. Phantom lines 62 represent an inner portion of the power chamber 30 which contains the cam driver assembly 46. Cooling fins 63 are provided on the outer portion of the power chamber 30. The area in the center at the middle ring 24 is a lubricant cavity 94.

The support ring 52 preferably maintains twelve power chambers 30 at 30° radial spacings.

Figure 5:
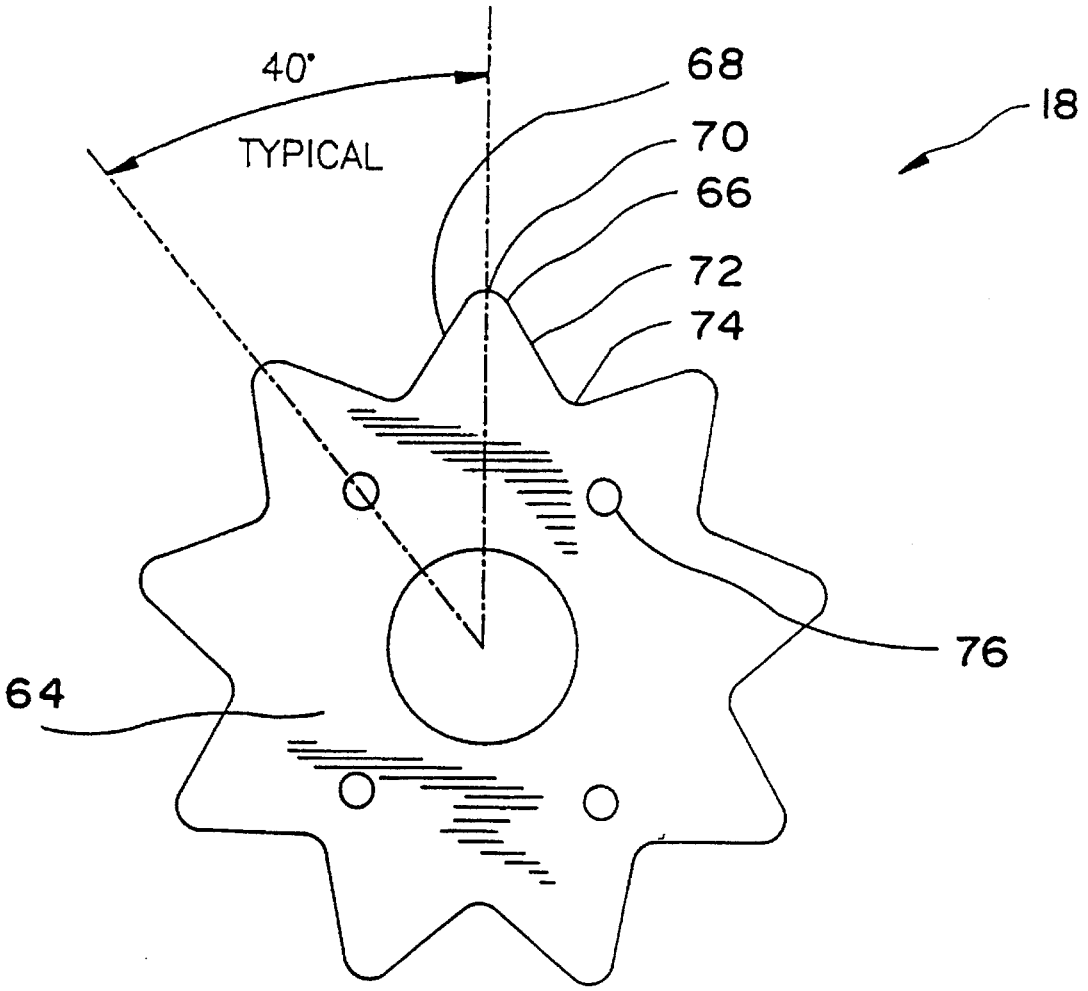
FIG. 5 is a front view of the central cam.

Referring now to FIG. 5, a front view of the central cam 18 is shown. Central cam 18 comprises a central hub 64 and a plurality of equally spaced, radially outward extending lobes 66, extending from the hub 64. Each lobe 66 comprises an ascending ramp 68 to an addendum 70 and a descending ramp 72 to a dedendum 74. There are preferably nine lobes, 40° apart. Opening 76 provides access for mounting bolt assembly 22 for securement to flange 20 of the torque shaft 14 (see FIG. 1).

Figure 6:
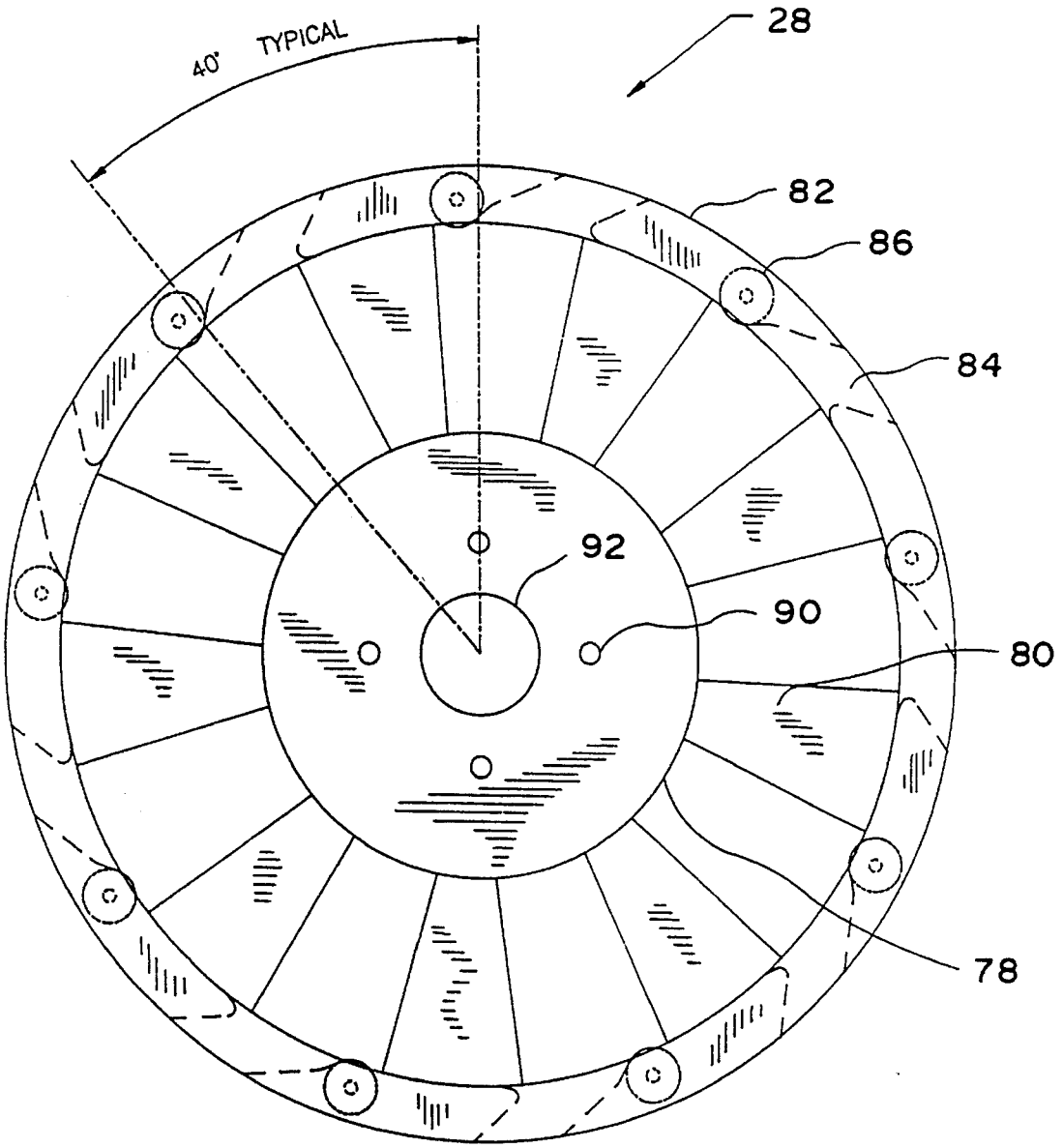
FIG. 6 is a rear view of the exhaust ring support system.

Referring now to FIG. 6, a rear view of the exhaust ring assembly 28 is shown. Exhaust ring assembly 28 comprises a central support element 78, a plurality of fan-shaped spokes 80 radiating from the central support element 78, and a vaned outer ring 82 supported by the spokes 80. Vanes 84 are angularly positioned to receive combustion products from outer ends of the power chambers 30 and thereby provide rotational force to the exhaust ring assembly 28.

The exhaust ring assembly 28 includes a plurality of rollers 86, each being positioned at the inner surface 88 (see FIG. 1) of the exhaust ring assembly 28 adjacent to a leading edge of a respective vane 84. The movement of the hinged exhaust valve 60 is controlled by the position of rollers 86. The shape of the leading edge of each vane 84 conforms with the exhaust valve range of motion.

The central support element 78 includes openings 90 for bolt and nut assemblies 22 and a central opening 92 for the torque shaft 14.

Figure 7:
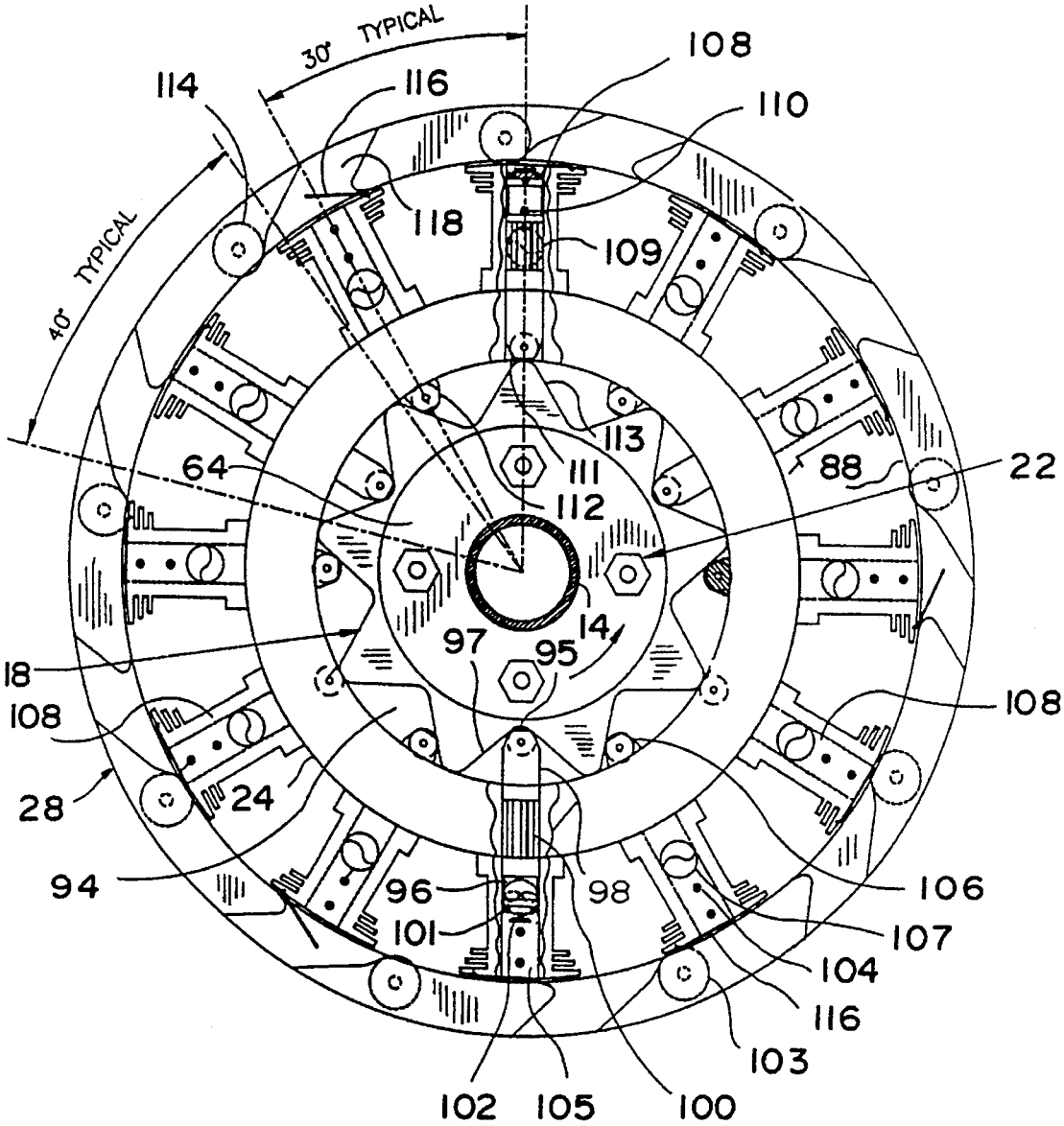
FIG. 7 is a front view of the invention, showing two cut-away portions of power chambers; the seal plates, bearing and the frame shown removed for the purpose of clarity.

Referring now to FIG. 7, in preparation for operation, a lubricant is added to the middle ring cavity 94 within the middle ring 24. As shown at the bottom of this figure, events of the power cycle begin with the cam driver 98 at a dedendum of cam 18 designated as numeral 95. As cam 18 rotates counterclockwise, ramp 97 of cam 18 drives cam driver 98, connector pins 100, and shuttle 101 outward closing valve 102. Roller 103 presses member 116 of an exhaust valve closed. Gases are trapped in the outer portion of the respective chamber designated as numeral 105. Fuel is injected into the trapped gases through port 104 at the approximate position designated as position 106. Concurrently, intake gases are entering the inner portion of the respective chamber designated as numeral 109 (see top of figure) through check valve 107 following the outward motion of the shuttle body 101. As the outward motion of the power shuttle assembly 96 continues, the trapped gases are compressed. Ignition is applied through port 110 as the power shuttle assembly 96 nears the position designated as numeral 108. Thermal expansion of the ignited gases forces power shuttle assembly 96 inward toward the position designated as numeral 112 forcing roller 111 between ramp 113 and the ring 24 causing cam 18 to rotate counterclockwise. As roller 114 releases valve 116, valve 116 directs exhaust gases through the vane area designated as numeral 118, applying rotational force to exhaust ring assembly 28. The numeral designation 108 shows that events are occurring simultaneously in three chambers of ring 24.

The forces developed at the ramps of cam 18 and vanes 118 are transmitted through the cam hub 64 and the structure of exhaust ring assembly 28 and bolt assemblies 22 to torque shaft 14.

Figure 8:
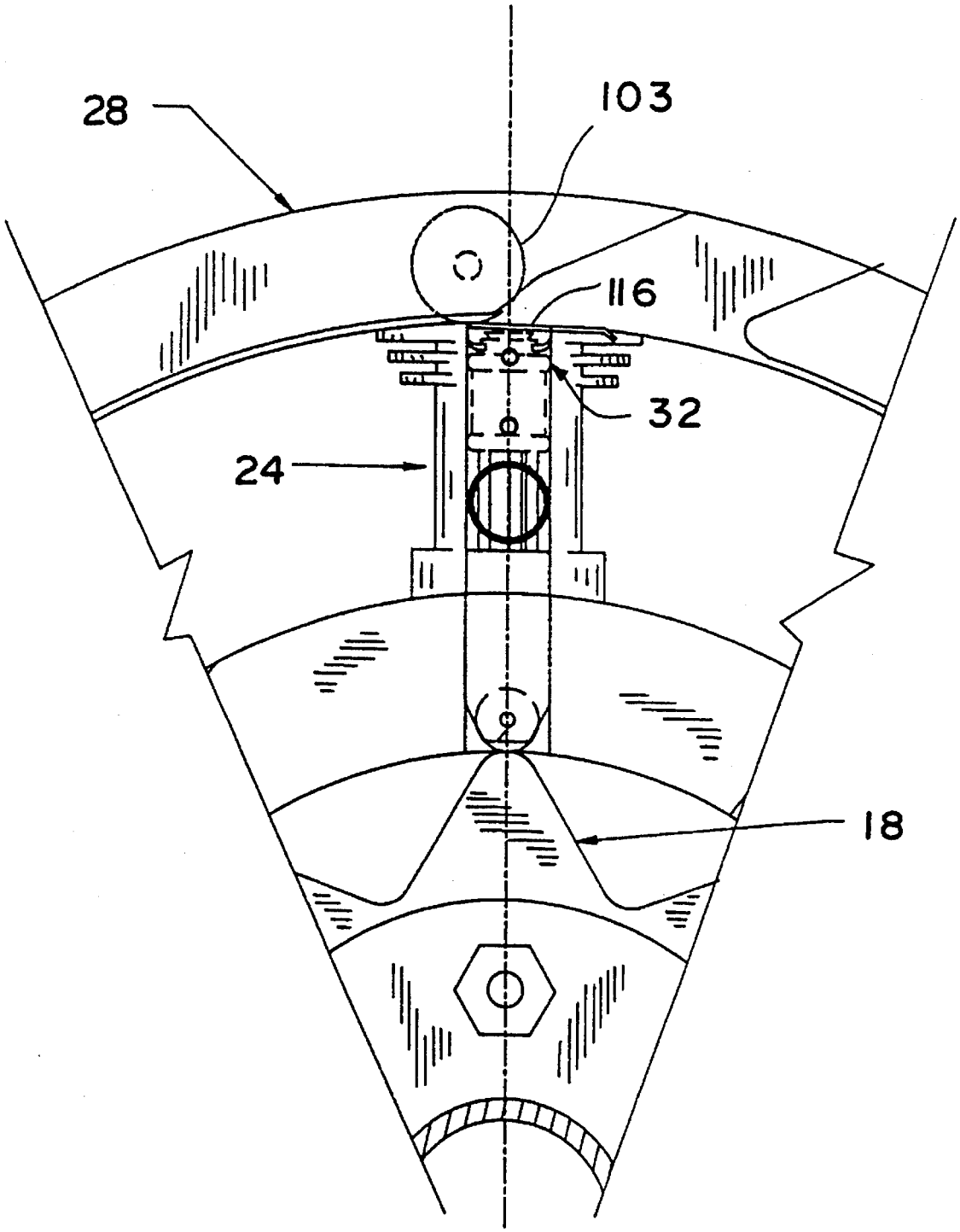
FIG. 8 is an enlarged view of a portion of the engine to reveal component relationships, particularly illustrating a power chamber with the power shuttle assembly in the outward position, the hinged exhaust valve being held closed by a roller of the exhaust ring.

The events continue to begin as each cam driver 98 passes through a dedendum of cam 18. FIG. 8 illustrates an enlarged view of a portion of the engine with the power shuttle assembly 32 in the outward position, the hinged exhaust valve 116 being held closed by the roller 103 of the exhaust ring assembly 28.

In summary, five events occur—intake, compression, ignition, power and exhaust simultaneously 120° degrees apart.

The present invention does not require a valve train. Due to the chamber design, it does not require lubrication at the outer end of the power chamber. This eliminates a large percentage of the inefficiency inherent in prior engine designs.

Inasmuch as the present invention reduces pumping action, compared to prior art engines, fuel efficiency increases and thermal efficiency increases.

The connector rods utilized by the present invention are relatively short compared to prior art connector rods. The connector rods of the present invention do not have to follow the entire 360° of the crankshaft rotation. The connector rods, of the present invention, instead, move in and out in relatively short strokes in response to 40° of cam travel.

Rotary motion of the present invention has advantages over the reciprocating motion of most prior art engines. Previous engine designs have used connecting rods to transfer piston forces to the crankshaft at journals. The present invention wedges three rollers at a time, between the fixed combustion chamber walls and the rotatable cam. These rollers, being 120° apart, centralize the forces applied to the torque shaft. The three at-a-time cam drivers of the present engine complete a five event cycle in 40° of cam travel.

In comparing the crankshaft journals of prior engine designs to the cam of the present invention, it is noted that the journals of most prior engine designs receive a power load once every 720° of travel, carrying a load of a maximum of 100°. The free lobe design of the present cam receives power loads every 20° and carries a load of about 10° The present engine has nine lobes. Thus each cam driver delivers power 180° in 720°.

Crankcases of most prior engines have had to be strong enough to withstand extreme pressure changes and long strokes of connecting rods. Heavy internal webs have been required. A large quantity of oil is needed in a pressurized oil system to protect journal bearings and to supply oil to all the bearings surfaces throughout the engine. The central casing of the present invention is the middle ring. The middle ring forms a housing containing unpressurized oil. The oil in this housing is in motion whenever the cam is in motion, permitting lubrication for the cam outer edge surface as well as the surfaces of the cam drivers.

The intake check valve of the present invention preferably has the same diameter as the power chamber. The shuttle valve can allow complete transfer of intake gases because of scavenging caused at the exhaust exit. The shuttle valve operates dynamically in response to pressure changes. The exhaust valve also preferably has the same diameter as the power chamber.

Obviously, many modifications and variations of the present invention are possible in light of the above teachings. It is, therefore, to be understood that within the scope of appended claims, the invention may be practiced otherwise than as specifically described.

What is claimed and desired to be secured by Letters Patent of the United States is:

1. A circular internal combustion engine, comprising:

a. a torque shaft;

b. a central cam connected to said torque shaft;

c. a stationary middle ring located about said central cam;

d. an exhaust ring assembly located about said middle ring and connected to said torque shaft and said central cam, said middle ring providing stationary support for a plurality of power chambers located between said central cam and said exhaust ring; and e. means for utilizing thermal energy from said power chambers to apply leverage on surfaces of said central cam and exhaust ring to provide rotational force.

2. The internal combustion engine of claim 1 wherein said central cam comprises a central hub and a plurality of equally spaced, radially outward extending lobes, extending from said hub.

3. The internal combustion engine of claim 2 wherein each lobe comprises an ascending ramp, to an addendum and a descending ramp to a dedendum.

4. The internal combustion engine of claim 3 wherein said means for utilizing thermal energy from said power chambers to apply leverage on surfaces of said central cam comprises a plurality of power shuttle assemblies, each positioned within a respective power chamber, each power shuttle assembly for transmitting combustion energy from combustion within said power chamber to said descending ramp of said central cam and to a portion of a surface of an inner end of said power chamber, thereby creating a wedging action and a commensurate rotational force on said central cam.

5. The internal combustion engine of claim 4 wherein said exhaust ring assembly comprises a plurality of angularly disposed vanes, formed therein, for receiving combustion products from an outer end of said power chamber and thereby providing rotational force to said exhaust ring assembly.

6. The internal combustion engine of claim 5 wherein said exhaust ring assembly comprises:

a. a central support element;

b. a plurality of fan-shaped spokes radiating from said central element; and c. a vaned outer ring supported by said fan-shaped spokes, said plurality of vanes being formed in said outer ring.

7. The internal combustion engine of claim 6 wherein said central cam, torque shaft and exhaust ring assembly comprise a single rotatable unit.

8. The internal combustion engine of claim 2 wherein said means for utilizing thermal energy comprises a plurality of power shuttle assemblies, each positioned within a respective power chamber, each power shuttle assembly, comprising:

a. a shuttle body positioned toward an outer portion of its power chamber including passages for allowing the transfer of fluid therewithin;

b. a shuttle valve contained within said shuttle body;

c. means for securing said shuttle valve within said shuttle body d. a cam driver assembly positioned toward an inner portion of said power chamber; and e. a plurality of spaced connector pins, positioned between said shuttle body and said cam driver assembly for transmitting forces from said shuttle body to said cam driver assembly and for spacing said shuttle body from said cam driver assembly to accommodate fluid intake into said respective power chamber.

9. The internal combustion engine of claim 5 wherein each power chamber includes a hinged exhaust valve at an outer end thereof which opens outwardly to time the flow of exhaust fluids.

10. The internal combustion engine of claim 9 wherein said exhaust ring assembly further comprises a plurality of rollers, each roller being positioned at the inner surface of said exhaust ring assembly adjacent to a leading edge of the respective vane.

* * * * *